US007395015B2

(12) United States Patent
Ishiguro et al.

(10) Patent No.: US 7,395,015 B2
(45) Date of Patent: Jul. 1, 2008

(54) TONER TRANSPORT DEVICE, TONER SUPPLY DEVICE, AND IMAGE FORMING APPARATUS

(75) Inventors: Yasuyuki Ishiguro, Higashiosaka (JP); Hiroshi Kubota, Kadoma (JP); Koichi Mihara, Fujiidera (JP)

(73) Assignee: Sharp Kabushiki Kaisha, Osaka (JP)

( * ) Notice: Subject to any disclaimer, the term of this patent is extended or adjusted under 35 U.S.C. 154(b) by 167 days.

(21) Appl. No.: 11/387,756

(22) Filed: Mar. 24, 2006

(65) Prior Publication Data

US 2006/0228134 A1 Oct. 12, 2006

(30) Foreign Application Priority Data

Mar. 25, 2005 (JP) ..... 2005-089892

(51) Int. Cl.
*G03G 15/08* (2006.01)

(52) U.S. Cl. ..... 399/258

(58) Field of Classification Search ..... 399/258–262, 399/358–360
See application file for complete search history.

(56) References Cited

U.S. PATENT DOCUMENTS 6,366,755 B1 4/2002 Takashima

FOREIGN PATENT DOCUMENTS

| | | | |
|---|---|---|---|
| JP | 01191884 A | * | 8/1989 |
| JP | 4-174467 A | | 6/1992 |
| JP | 10-239977 A | | 9/1998 |
| JP | 11242418 A | * | 9/1999 |
| JP | 2003-167413 A | | 6/2003 |
| JP | 2005049850 A | * | 2/2005 |

* cited by examiner

*Primary Examiner*—Ryan Gleitz
(74) *Attorney, Agent, or Firm*—Nixon & Vanderhye P.C.

(57) ABSTRACT

A toner transport device includes a toner transport path for passing toner, and a toner transport pipe disposed so as to have an up-and-down direction in which the toner transport path extends. Further, the toner transport device includes a pipe supporting member for supporting the toner transport pipe, which is supported so as to move up and down. This allows the toner transport pipe to vibrate up and down, thereby properly preventing retention and solidification of toner inside the toner transport path.

15 Claims, 6 Drawing Sheets

TONER TRANSPORT DEVICE, TONER SUPPLY DEVICE, AND IMAGE FORMING APPARATUS

This Nonprovisional application claims priority under 35 U.S.C. § 119(a) on Patent Application No. 089892/2005 filed in Japan on Mar. 25, 2005, the entire contents of which are hereby incorporated by reference.

FIELD OF THE TECHNOLOGY

The present technology relates to a toner transport device for transporting toner, a toner supply device including the toner transport device, and an image forming apparatus including the toner supply device.

BACKGROUND

Conventionally, image forming apparatuses employing an electrophotographic system such as a copier, a printer, and a facsimile machine have been widely known. In such image forming apparatuses, an electrostatic latent image is formed on a surface of a photoreceptor. The electrostatic latent image is developed with toner, and a toner image thus obtained is transferred and fixed onto a sheet such as a paper sheet or the like. The toner used to develop the electrostatic latent image is supplied from the developing device to the surface of the photoreceptor. To the developing device, toner is supplied from a toner cartridge via a toner transport device. In a structure in which a toner cartridge is disposed over a developing device, a toner transport device is provided with a toner transport path extending in an up-and-down direction.

On the other hand, in recent years, with the improvement in high image quality of image forming apparatuses, particles of toner have been designed to have a micro diameter. A toner having such micro particles generally does not have good fluidity, so that retention and solidification of toner easily occur in a toner transport path of a toner transport device. In order to overcome such a problem, a toner transport device needs some contrivances.

For example, an apparatus disclosed in patent document 1 (Japanese Unexamined Patent Publication, No. 174467/1992 (Tokukaihei 4-174467, publication date: Jun. 22, 1992) is arranged such that four developing devices for different colors are disposed in the up-and-down direction and toner is supplied from a toner hopper (equivalent to a toner cartridge) to the developing devices. The developing devices are movable in upward and downward directions so as to face a photoreceptor when used. To enable such movements, an accordion pipe is used for a toner transport path through which toner is supplied from the toner hopper to the developing devices. Further, a rotator is provided by the accordion pipe. The rotator has a plurality of protrusions provided thereon in its circumferential direction, and is driven by a motor so as to rotate. That is, in the patent document 1, by rotary motion of the rotator, the protrusions disposed on the rotator repeatedly hit the outer surface of the accordion pipe, causing toner remaining in pleats of the inner surface of the accordion pipe to fall off.

Further, patent document 2 (Japanese Unexamined Patent Publication, No. 296731/2001 (Tokukai 2001-296731, publication date: Oct. 26, 2001) discloses an apparatus in which four developing devices for different colors are arranged in a lateral line and supplied with toner from respective toner cartridges via a first transport path and a second transport path. Inside the second toner transport path disposed in an up-and-down direction (vertical direction), a spring agitator is provided that moves in upward and downward directions. The movement of the spring agitator corresponds to rotation of an auger, which is provided inside the first transport path disposed in the horizontal direction. That is, in the patent document 2, toner is prevented from adhering to the inner wall of the second transport path, by causing the spring agitator to move in the upward and downward directions inside the second transport path.

However, the conventional structures have difficulties in properly preventing retention and solidification of toner in a toner transport path disposed in the up-and-down direction.

Specifically, in the patent document 1, since the toner transport path disposed in the up-and-down direction is an accordion pipe, structurally, the transport path does not easily prevent retention and solidification of toner inside the toner transport path. In addition, since the rotator gives impacts and vibration to part of the toner transport path, toner easily remains and solidifies in a portion away from the rotator.

Further, in the patent document 2, since the spring agitator is disposed inside the second transport path disposed in the up-and-down direction, toner easily remains and solidifies on the surface of the spring agitator. That is, the spring agitator itself tends to become a cause of restricting toner transport.

SUMMARY OF THE INVENTION

It is a feature of an exemplary embodiment presented herein to provide a toner transport device, a toner supply device, and an image forming apparatus, which prevent retention and solidification of toner inside a toner transport path disposed in an up-and-down direction.

To solve the forgoing problems, a toner transport device of an exemplary embodiment includes: a toner transport path for passing toner; a toner transport member disposed so as to have an up-and-down direction in which the toner transport path extends; and a supporting member for supporting the toner transport member, the toner transport member being supported by the supporting member so as to move up and down.

According to the arrangement, since the toner transport member is supported by the supporting member so as to move up and down, the entire toner transport member can move in upward and downward directions with respect to the supporting member. This allows the entire toner transport member to evenly vibrate in the upward and downward directions, thereby preventing retention and solidification of toner in the toner transport path of the toner transport member.

In this case, it is possible to properly prevent retention and solidification of toner in the toner transport path with a simple structure, compared to a structure in which a spring agitator is disposed in a toner transport path and easily causes toner residue or a structure in which a toner transport member has an accordion configuration.

BRIEF DESCRIPTION OF THE DRAWINGS

FIG. 4(*b*) is a vertical cross-sectional view illustrating a state in which the shutter is opened in the toner transport device of FIG. 1.

DESCRIPTION OF THE EMBODIMENTS

First Embodiment

With reference to figures, one exemplary embodiment is described below.

Figure 2:
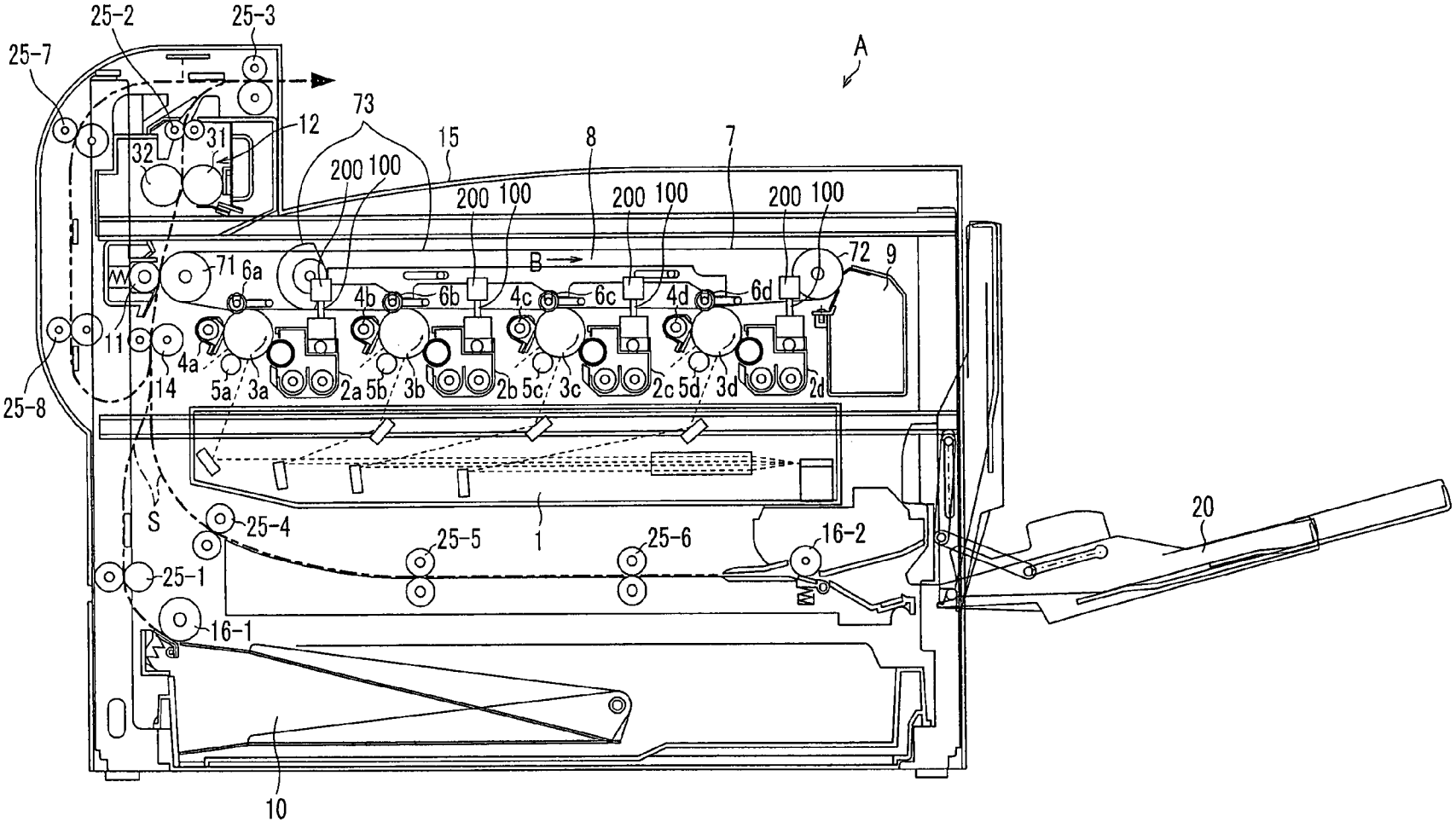
FIG. 2 is a cross-sectional view illustrating an image forming apparatus including the toner supply device of FIG. 1.

FIG. 2 is an explanatory drawing illustrating a structure of an image forming apparatus A of the present embodiment. The image forming apparatus A forms a multicolor image or a monochrome image on a sheet (recording paper sheet), based on externally inputted image data or image data obtained by reading a document.

As illustrated in FIG. 2, the image forming apparatus A includes an exposure unit 1, developing devices 2, photosensitive drums 3, charging devices 5, cleaner units 4, an intermediate transfer belt unit 8, a fixing unit 12, a sheet transport path S, a paper feed tray 10, a paper output tray 15, and the like.

The image forming apparatus A handles image data of a color image with different colors such as black (K), cyan (C), magenta (M), and yellow (Y). Therefore, in order to realize four latent images that respectively correspond to the four colors, four sets are provided for each of the developing devices 2 (2*a*, 2*b*, 2*c*, and 2*d*), the photosensitive drums 3 (3*a*, 3*b*, 3*c*, and 3*d*), the charging devices 5 (5*a*, 5*b*, 5*c*, and 5*d*), and the cleaner units 4 (4*a*, 4*b*, 4*c*, and 4*d*). The symbols a, b, c, and d correspond to black, cyan, magenta, and yellow, respectively. With the means sorted by the symbols, four image stations are configured.

In the image stations, the photosensitive drums 3 are disposed in the upper part of the image forming apparatus A. The charging devices 5 serve to uniformly charge surfaces of the photosensitive drums 3 at a certain voltage. The charging devices 5 may be contact roller type as shown in FIG. 2, contact brush type, or charger type.

For the exposure unit 1, as illustrated in FIG. 2, a laser scanning unit (LSU) may be used which includes a laser radiation section and a reflecting mirror. Alternatively, for example, an EL or LED record head may be used in which light emitting elements are arranged in array(s). The exposure unit 1 exposes the charged photosensitive drums 3 according to inputted image data, so that electrostatic latent images corresponding to the image data are formed on the respective surfaces of the photosensitive drums 3.

The developing devices 2 cause the electrostatic latent images formed on the photosensitive drams 3 to be visualized using the toners of the colors K, C, M, and Y. The cleaner units 4 remove and collect toner remaining on the surfaces of the photosensitive drums 3 after the developing process and image transfer process are carried out.

On the photosensitive drums 3 is disposed the intermediate transfer belt unit 8. The intermediate transfer belt unit 8 includes intermediate transfer rollers 6 (6*a*, 6*b*, 6*c*, and 6*d*), an intermediate transfer belt 7, an intermediate transfer belt driving roller 71, an intermediate belt following roller 72, intermediate transfer belt tension mechanisms 73, and an intermediate belt cleaning unit 9.

The intermediate transfer rollers 6, the intermediate transfer belt driving roller 71, the intermediate transfer belt following roller 72, the intermediate transfer belt tension mechanism 73 and the like serve to stretch and drive the intermediate transfer belt 7 to rotate in a direction indicated by an arrow B.

The intermediate transfer rollers 6 are mounted on and supported by intermediate transfer roller mounting sections in the intermediate transfer belt tension mechanism 73 for rotary motion. The intermediate transfer rollers 6 serve to apply a transfer bias to transfer toner images formed on the photosensitive drums 3 onto the intermediate transfer belt 7.

The intermediate transfer belt 7 is provided so as to contact the photosensitive drums 3. On the intermediate transfer belt 7, colored toner images formed on the photosensitive drums 3 are transferred and overlapped one by one, realizing a colored toner image (multicolored toner image). The intermediate transfer belt 7 is formed to be an endless belt, using a film having a thickness of approximately 100 μm to 150 μm.

Transfer operation of the toner images from the photosensitive drums 3 to the intermediate transfer belt 7 is carried out by the intermediate transfer rollers 6, which are in contact with a backside of the intermediate transfer belt 7. The intermediate transfer rollers 6 are biased with a high voltage transfer bias (a high voltage having a reverse polarity (+) with respect to a polarity (−) in which the toners are charged). Each of the intermediate transfer rollers 6 is formed on a metal axis (e.g. stainless) having a diameter of 8 mm to 10 mm, and its surface is coated with conducting elastic material (e.g. EPDM, foamed urethane, etc.). With the conducting elastic material, the intermediate transfer rollers 6 can uniformly apply a high voltage to the intermediate transfer belt 7. In the present embodiment, a transfer electrode of roller type (intermediate transfer roller 6) is used. However, a transfer electrode of other types such as brush type may be also used.

As described above, electrostatic latent images on the photoreceptors 3 are made to be visible using the toners of the respective colors, so as to become individual toner images. Then, the toner images are superimposed one another on the intermediate transfer belt 7. In this way, the superimposed toner images are transported to a contact point at which the intermediate transfer belt 7 and a sheet transported by rotation of the intermediate transfer belt 7 come in contact, and transferred onto the sheet by a transfer roller 11 disposed at the point. In this case, the intermediate transfer belt 7 and the transfer roller 11 are pressured and contacted each other at a predetermined nip, while a voltage for transferring the toner image onto the sheet is applied to the transfer roller 11. The voltage is high and has a reverse polarity (+) with respect to a polarity (−) in which the toners are charged.

In order to gain the nip steadily, either one of the transfer roller 11 and the intermediate transfer belt driving roller 71 is made of hard material such as metal or the like, while the other one is made of soft material, i.e., an elastic roller or the like (elastic rubber roller, foamed resin roller, etc.).

Some toners remain on the intermediate transfer belt 7, such as a toner adhered to the intermediate transfer belt 7 when the intermediate transfer belt 7 and the photosensitive drums 3 come in contact, or a toner that was not transferred onto the sheet and remains on the intermediate transfer belt 7. Such toners are removed by the intermediate transfer belt cleaning unit 9, because the remained toners may be causes for color mixture in subsequent processes. The intermediate transfer belt cleaning unit 9 includes, for example, a cleaning blade which serves as a cleaning member and contacts the intermediate transfer belt 7. The intermediate transfer belt cleaning unit 9 comes in contact with a portion of the intermediate transfer belt 7, and at the portion, the intermediate transfer belt 7 is supported from its backside by the intermediate transfer belt following roller 72.

The paper feed tray 10, provided below an image formation section and the exposure unit 1, serves to hold sheets (e.g. recording paper sheets) to be used for image formation. On the other hand, the paper output tray 15, provided on the top of the image forming apparatus A, is where printed sheets are put with their front sides facing down.

Further, in the image forming apparatus A, the sheet transport path S is provided which serves to transport sheets from the paper feed tray 10 or from a manual paper feed tray 20 to the paper output tray 15 via the transfer section 11 and the fixing unit 12. From the paper feed tray 10 to the paper output tray 15 in the sheet transport path S, there are provided: the transfer section including pickup rollers 16, a resist roller 14, and the transfer roller 11; the fixing unit 12; transport rollers 25; and the like.

The transport rollers 25, provided along the sheet transport path S, are small rollers serving to facilitate and assist transport of sheets. The pickup rollers 16, disposed at the edges of the paper feed tray 10, serve as guiding rollers for transporting sheets to the sheet transport path S one by one. The resist roller 14 temporarily holds a sheet being transported on the sheet transport path S, and feeds the sheet to the transfer section at the timing of matching the leading edge of the sheet with the top edge of a toner image formed on a photosensitive drum.

The fixing unit 12 includes a heat roller 31, a pressure roller 32, and the like. The heat roller 31 and the pressure roller 32 rotate, while nipping a sheet therebetween. The heat roller 31 is controlled by a control section (not shown) so as to maintain a predetermined fixed temperature. The control section controls the heat roller 31 based on a detection signal supplied from a temperature sensor (not shown). Together with a pressure roller 32, the heat roller 31 fixes the sheet by thermo-compression bonding, and fuses, mixes, pressures and fixes the colored toner image transferred on the sheet so as to heat fix the image onto the sheet. This realizes heat fixing of the image onto the sheet. Further, the sheet on which the multi-colored toner image (toner image with colors) was fixed is transported by the transport rollers 25 to a reversed paper output path of the sheet transport path S, and outputted to the paper output tray 15 with the sheet inverted (with the multi-colored image facing down).

Described next is sheet transport operation through the sheet transport path S, including processes performed by the sections. As described above, the image forming apparatus A includes the paper feeding cassette 10 for holding sheets beforehand, and the manual paper feed tray 20 used in printing a few sheets and the like. For both of the paper feeding cassette 10 and the manual paper feed tray 20, the pickup rollers 16 (16-1 and 16-2) are provided, so that each of the pickup rollers 16 feeds sheets to the sheet transport path S one by one.

(For Single-sided Printing)

A sheet fed from the paper feeding cassette 10 is transported up to the resist roller 14 by the transport roller 25-1 disposed on the sheet transport path S. Then, the sheet is outputted to the transfer section by the resist roller 14, at the timing of matching the leading edge of the sheet with the top edge of a toner image superimposed on the intermediate transfer belt 7. In the transfer section, the toner image is transferred, and fixed onto the sheet by the fixing unit 12. Further, the sheet is passed through the transport roller 25-2 and outputted from the paper output roller 25-3 to the paper output tray 15.

On the other hand, a sheet fed from the manual paper feed tray 20 is transported to the resist roller 14 by the transport rollers 25 (25-6, 25-5, and 25-4). In the subsequent path, the sheet is transported and outputted to the paper output tray 15 in a manner similar to the case where a sheet is fed from the paper feeding cassette 10.

(For Double-sided Printing)

As to a sheet having had its one side printed and passed through the fixing unit 12, the bottom edge of the sheet is held by the paper output roller 25-3. Then, the sheet is rotated in a reversed direction to be guided to the transport rollers 25-7 and 25-8, undergone through the backside printing of the sheet, and outputted to the paper output tray 15.

In FIG. 2, toner transport devices 100 are disposed on the developing devices 2. Further, on the toner transport devices 100, toner cartridges (toner replenishing devices) 200 are provided. The developing devices 2 and the toner cartridges 200 are connected by the toner transport devices 100, respectively. Further, toners stored in the toner cartridges 200 are supplied to the developing devices 2 via the toner transport devices 100, respectively.

Figure 1:
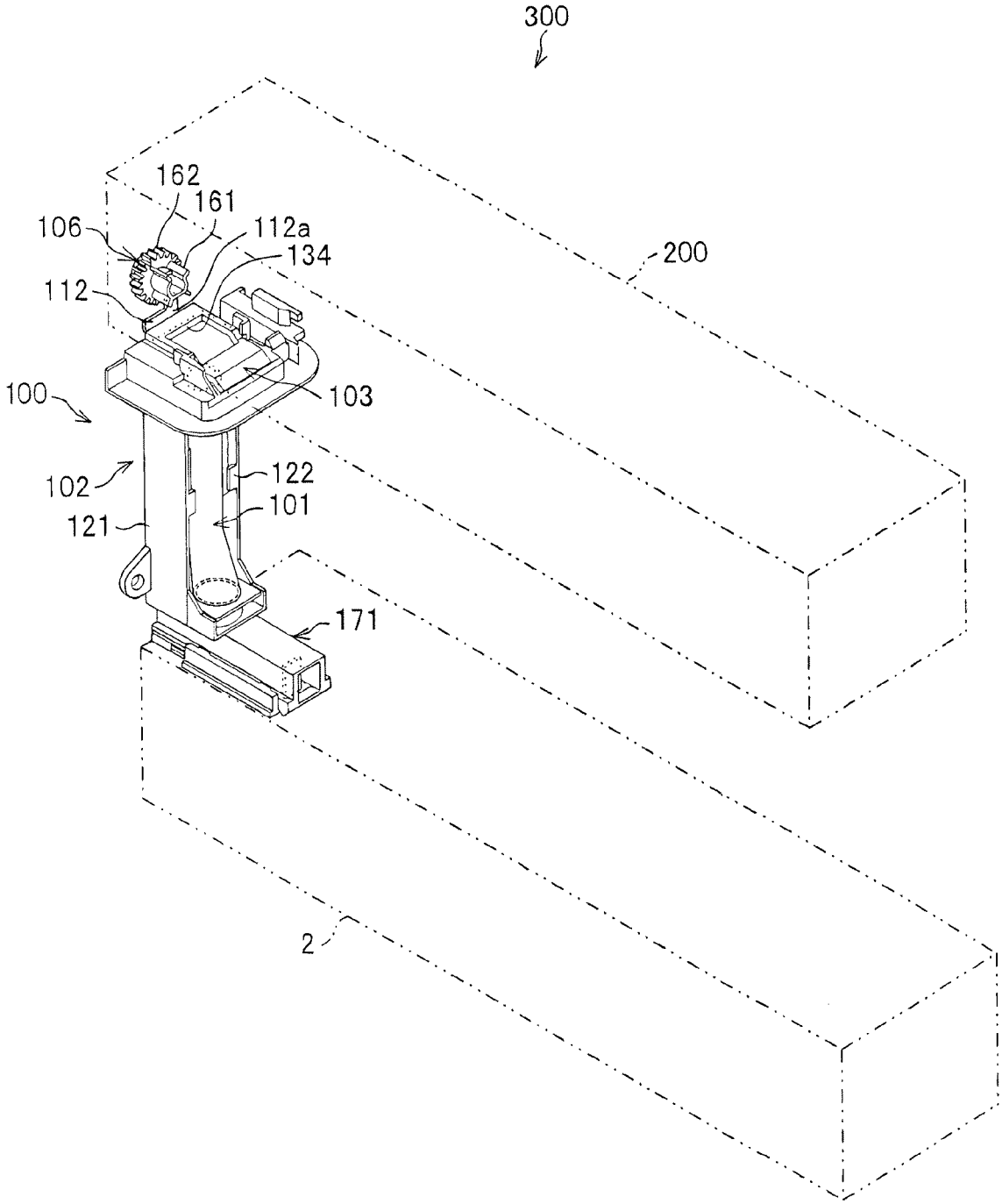
FIG. 1 is a perspective view illustrating a schematic structure of a toner supply device of one embodiment.

FIG. 1 is a perspective view of a toner supply device 300. The toner supply device 300 includes a developing device 2, a toner transport device 100, and a toner cartridge 200. In order to simplify the structure of the toner transport device 100, FIG. 1 shows the developing device 2 and the toner cartridge 200 as rectangular prisms indicated by chain double-dashed lines. That is, in the present embodiment, the developing device 2 and the toner cartridge 200 may have conventionally known structures and functions.

In the present embodiment, the toner transport device 100, the toner cartridge 200, and the developing device 2 are configured to be in the form of horseshoe. This is because the intermediate transfer belt 7 moves between the toner transport device 100 and the developing device 2 as illustrated in FIG. 2.

Figure 3:
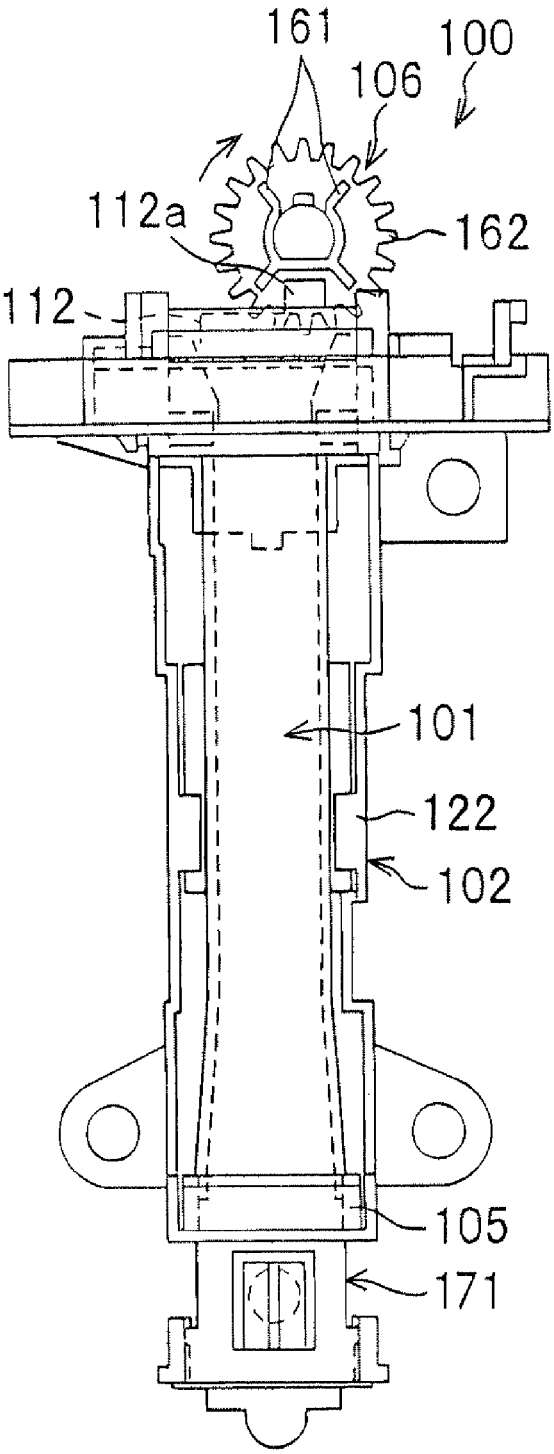
FIG. 3 is a front view illustrating the toner transport device of FIG. 1.
Figure 4:
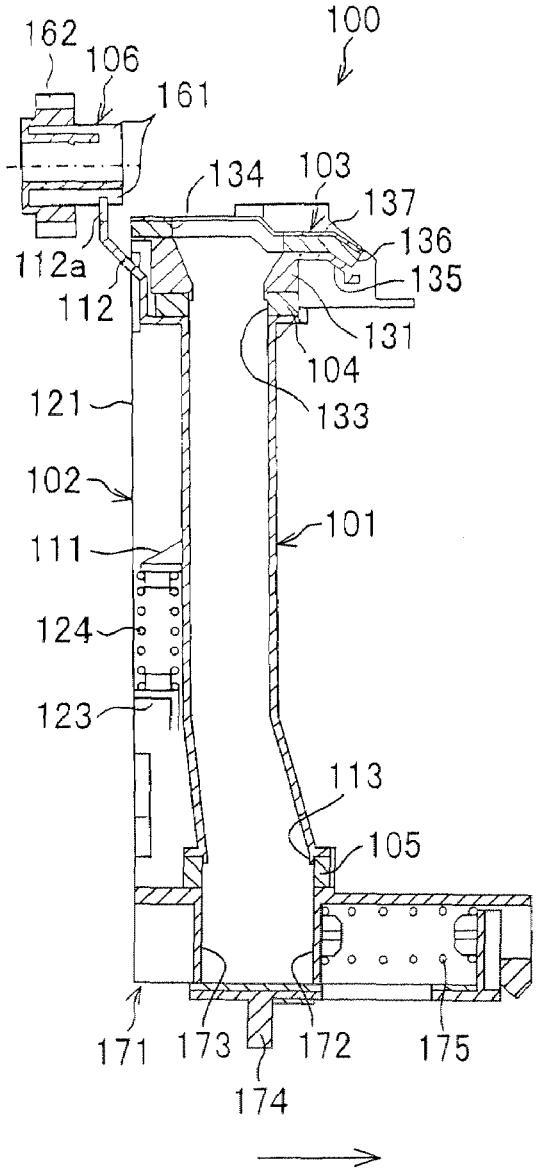
FIG. 4(*a*) is a vertical cross-sectional view illustrating a state in which a shutter is closed in the toner transport device of FIG. 1.
Figure 4:
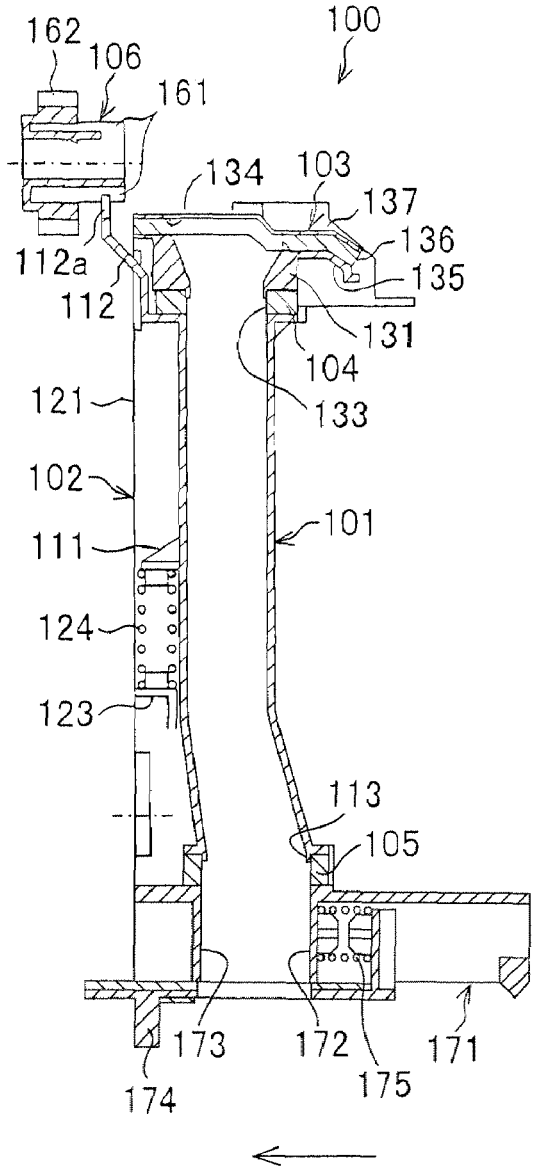
Figure 5:
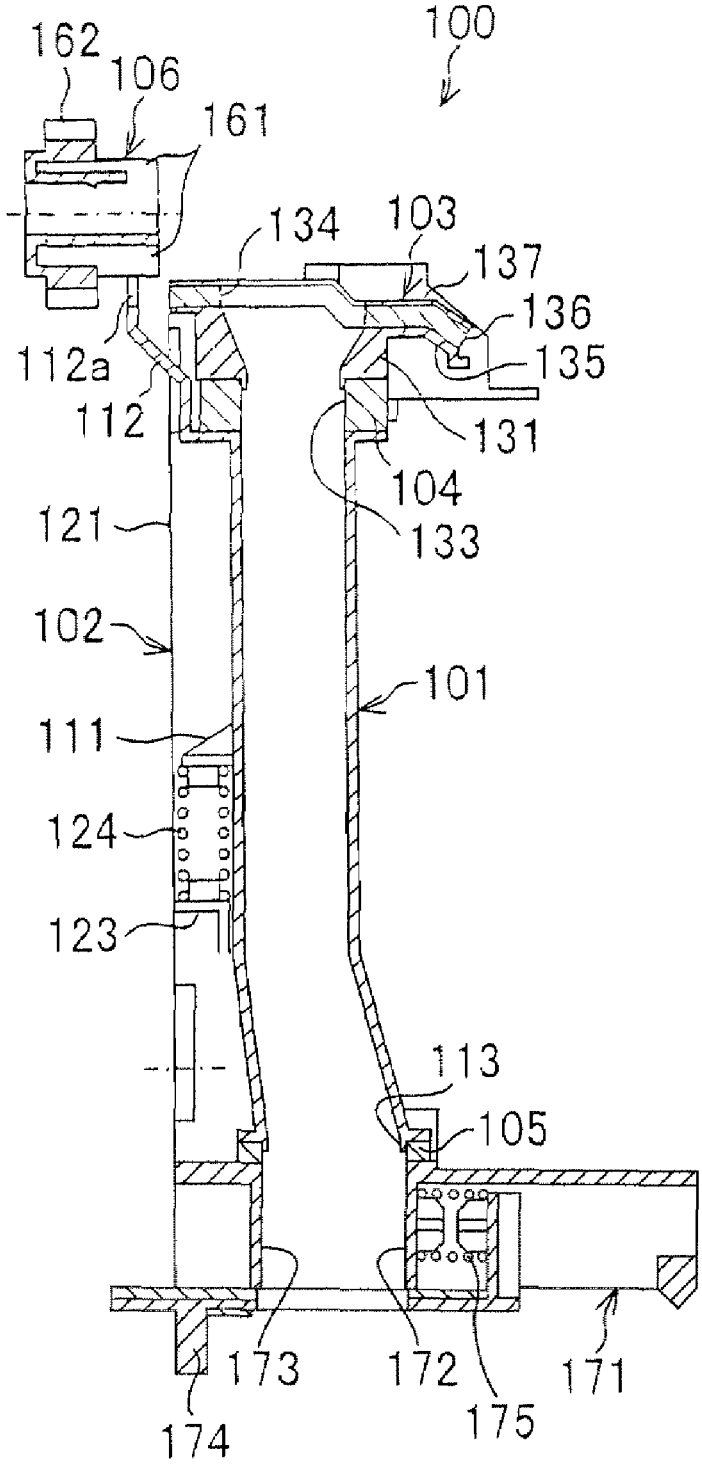
FIG. 5 is a vertical cross-sectional view illustrating a state in which a toner transport pipe is pushed downward by a rotator in the toner transport device of FIG. 4(*b*).
Figure 6:
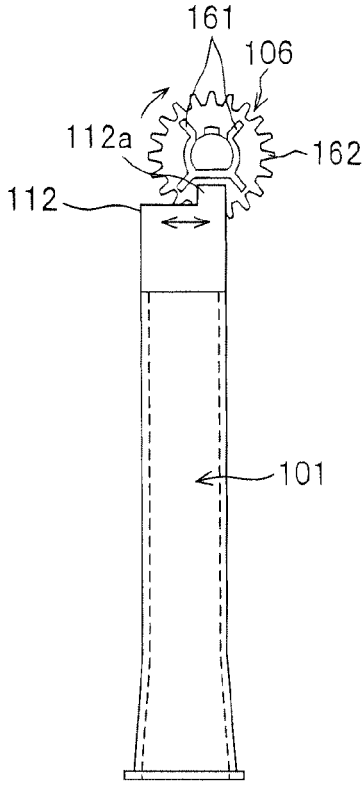
FIG. 6 is an explanatory drawing illustrating a state in which operation wings of the rotator are detached from a protruded tag section of the toner transport pipe in the toner transport device of FIG. 1.
Figure 7:
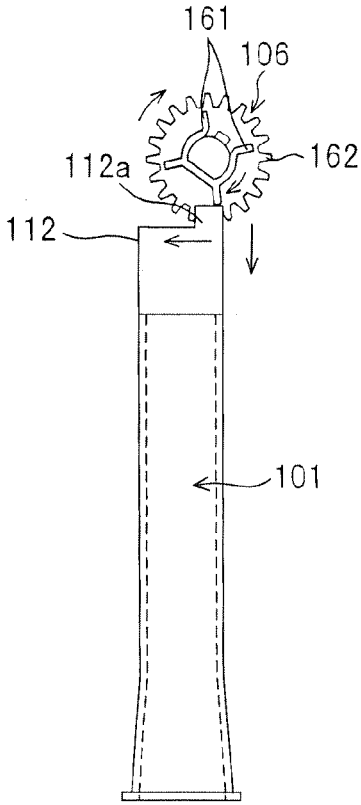
FIG. 7 is an explanatory drawing illustrating how the operation wings of the rotator drive the toner transport pipe to move downward and to vibrate in a horizontal direction in the toner transport device of FIG. 1.

FIG. 3 is a front view of the toner transport device 100, and FIGS. 4(*a*) and 4(*b*) are vertical cross-sectional views of the toner transport device 100. As illustrated in FIGS. 4(*a*) and 4(*b*), the toner transport device 100 includes a toner transport pipe (toner transport member) 101, a pipe supporting member (supporting member) 102, an upper foamed elastic member (elastic member, foamed elastic member) 104, a lower foamed elastic member (elastic member, foamed elastic member) 105, and a rotator (rotary motion and linear motion conversion mechanism) 106.

The toner transport pipe 101 is a member formed in a pipe shape, extending in the up-and-down direction. The toner transport pipe 101 contains a toner transport path, and is supported by the pipe supporting member 102 so as to be movable in the upward and downward directions. The pipe supporting member 102 covers the back of the toner transport pipe 101, and on the back of the toner transport pipe 101 is provided a spring stopper section 111. Further, on the top edge of the toner transport pipe 101 is provided a protruded tag section (rotary motion and linear motion conversion mechanism) 112. On the top of the protruded tag section 112 is provided an operating protrusion section 112*a* that is further protruded from a portion of the protruded tag section 112.

In the present embodiment, the toner transport pipe 101 serving as a toner transport path contains a round hollow area, and its inner wall has a smooth curved surface. Specifically, the inner wall is a smooth round surface having no concaves and protrusions where toner particles can remain.

The toner transport pipe 101 has a minimum internal diameter at its top edge. The internal diameter of toner transport pipe 101 gradually becomes large toward the downstream, so as to be maximum at its bottom end. In the present embodiment, the internal diameter is ϕ9.5 mm at the top end and ϕ10 mm at the bottom end. Due to the difference in the internal diameter between the top end and the bottom end, toner supplied from the top end is allowed to pass smoothly without remaining somewhere in the toner transport pipe 101, so as to easily reach the bottom end. In order to obtain such a functional capability, the difference in the internal diameter between the top end and the bottom end should be at least not less than ϕ0.1 mm, preferably not less than ϕ0.2 mm.

In the present embodiment, the toner transport pipe 101 is warped at its lower part in consideration of the internal configuration of the image forming apparatus A. That is, the shape of the toner transport pipe 101 is not limited to this and may be straight, for example.

In order to support the toner transport pipe 101 for its up and down movements, the pipe supporting member 102 includes an upper supporting section, a lower supporting section, and an intermediate supporting section 121 disposed in between. The upper supporting section includes a supporting plate section 135 and a guiding pipe section 131, and the lower supporting section includes a transport pipe receiving section 171.

As illustrated in FIG. 1, the intermediate supporting section 121 is, for example, in a box shape. The intermediate supporting section 121 has supporting protrusion sections 122 protruded toward the toner transport pipe 101. The supporting protrusion sections 122 are provided, for example, in the vicinity of the middle part of the intermediate supporting section 121 in the up-and-down direction. As such, since the toner transport pipe 101 is partially supported by the supporting protrusion sections 122 at the vicinity of its middle part, the toner transport pipe 101 is allowed to move up and down and vibrate from side to side.

As illustrated in FIGS. 4(*a*) and 4(*b*), a spring stopper section 123 is provided on an internal surface of the intermediate supporting section 121. The spring stopper section 123, positioned on the internal surface facing the back of the toner transport pipe 101, is located below the spring stopper section 111 disposed on the toner transport pipe 101. Further, a coil spring (biasing member, rotary motion and linear motion conversion mechanism) 124 is disposed between the spring stopper sections 111 and 123. The coil spring serving as an elastic member is a compression spring.

The upper supporting section of the pipe supporting member 102 includes the supporting plate section 135 in its upper part and the guiding pipe section 131 in its lower part. The guiding pipe section 131 serves to guide toner, supplied through a toner supply port 134 of a toner cartridge mounting section 103, to the toner transport pipe 101. Therefore, an internal diameter of the guiding pipe section 131 at its bottom end is set so as to correspond to an internal diameter of the toner transport pipe 101.

The bottom end of the guiding pipe section 131 is connected to the top end of the toner transport pipe 101 via the upper foamed elastic member 104. The upper foamed elastic member 104 contains a toner passage having a diameter corresponding to an internal diameter of the toner transport pipe 101, and has a ring structure so as to prevent toner leakage to the outside. A top surface of the upper foamed elastic member 104 is adhered to a bottom end surface of the guiding pipe section 131, and a bottom surface of the upper foamed elastic member 104 is adhered to a top end surface of the toner transport pipe 101.

In order to simplify the positioning of the upper foamed elastic member 104 onto the bottom end surface, a positioning protrusion section (positioning section) 133 for positioning the upper foamed elastic member 104 is provided on the bottom end surface (adhesive surface) of the guiding pipe section 131. The positioning protrusion section 133 is protruded downward along an inner wall of the guiding pipe section 131. The shape of the positioning protrusion section 133 is not particularly limited and may be any shape that allows the positioning of the upper foamed elastic member 104. For example, the positioning protrusion section 133 may be formed in a ring shape so as to extend along the inner wall of the guiding pipe section 131, or may partially have protrusion(s) along the inner wall of the guiding pipe section 131.

Further, in the present embodiment, the positioning protrusion section 133 is provided on the bottom end surface (adhesive surface) of the guiding pipe section 131. However, the positioning protrusion section 133 may be provided on the adhesive surface on the top end surface of the toner transport pipe 101, or may be formed on the both adhesive surfaces if possible.

On the supporting plate section 135 constituting the upper supporting section of the pipe supporting member 102, a toner cartridge mounting section (toner replenishing device mounting section) 103 is provided. Through the toner cartridge mounting section 103, a toner supply port 134 is provided so as to supply toner into the guiding pipe section 131. The toner cartridge mounting section 103, formed in a plate shape, includes a foamed elastic member 136 and a mylar film 137 which are stacked in this order. When the toner cartridge 200 is inserted onto or removed from the toner transport device 100, the toner cartridge 200 slides on the toner cartridge mounting section 103. Thus, in order to prevent abrasion of the foamed elastic member 136 and facilitate smooth sliding of the toner cartridge 200, the mylar film 137 is provided on the foamed elastic member 136 as noted above. Note that, when the toner cartridge 200 is inserted onto the toner transport device 100, a toner exhaust port of the toner cartridge device 200 (not shown) fits the toner supply port 134 of the toner transport device 100.

Further, instead of the mylar film 137, for example, a PET (polyethylene terephthalate) film or a PTFE (polytetrafluoroethylene) film may be used. Specifically, the foamed elastic member 136 preferably has thereon a layer required to have a frictional coefficient of less than that of a surface of the foamed elastic member 136 when the toner cartridge 200 is slid and inserted. It is more preferable that the layer have a high abrasion resistance.

The bottom end of the toner transport pipe 101 is connected to the transport pipe receiving section 171 of the pipe supporting member 102 via the lower foamed elastic member 105. The lower foamed elastic member 105 contains a toner passage having a diameter corresponding to an internal diameter of the toner transport pipe 101, and has a ring structure so as to prevent toner leakage to the outside. A top surface of the lower foamed elastic member 105 is adhered to the bottom end surface of the toner transport pipe 101, and a bottom surface of the lower foamed elastic member 105 is adhered to a top surface of the transport pipe receiving section 171.

As in the case of the bottom end surface of the guiding pipe section 131, the bottom end surface (adhesive surface) of the toner transport pipe 101 is provided with a positioning protrusion section (positioning section) 113, in order to simplify the positioning of the lower foamed elastic member 105 to the bottom end surface of the toner transport pipe 101. The positioning protrusion section 113 is protruded downward along the inner wall of the toner transport pipe 101. Like the positioning protrusion section 133, the shape of the positioning protrusion section 113 is not particularly limited and may be any shape that allows the positioning of the lower foamed elastic member 105. For example, the positioning protrusion section 113 may be formed in a ring shape so as to extend along the inner wall of the guiding pipe section 101, or may partially have protrusion(s) along the inner wall of the toner transport pipe 101.

Further, in the present embodiment, the positioning protrusion section 113 is provided on the bottom end surface (adhesive surface) of the toner transport pipe 101. However, the positioning protrusion section 113 may be provided on the adhesive surface of the transport pipe receiving section 171, or may be formed on the both adhesive surfaces if possible.

The transport pipe receiving section 171 contains a toner exhaust passage (toner passage) 172, whose bottom end serves as a toner exhaust port 173 led to the developing device 2. The toner exhaust port 173 has a shutter 174 capable of sliding. The shutter 174 is biased by an elastic member, i.e., a coil spring 175, provided inside the transport pipe receiving section 171. When the toner transport device 100 is not mounted on the developing device 2, the toner transport device 100 is in a closed state as illustrated in FIG. 4(*a*). On the other hand, when the toner transport device 100 is mounted on the developing device 2, in response to the movement of the toner transport device 100 being inserted onto the developing device 2, the shutter 174 is pushed and moved by the developing device 2, thereby becoming in an opened state as illustrated in FIG. 4(*b*).

The upper foamed elastic member 104 and the lower foamed elastic member 105 can be deformed with the application of external pressure. When the external pressure is released, the upper foamed elastic member 104 and the lower foamed elastic member 105 can return in their initial shapes. As such, the toner transport pipe 101 is connected to the toner cartridge mounting section 103 via the upper foamed elastic member 104, while being connected to the transport pipe receiving section 171 of the pipe supporting member 102 via the lower foamed elastic member 105. With the above structure, between the toner cartridge mounting section 103 and the transport pipe receiving section 171, the toner transport pipe 101 can move up and down, and from side to side (vibrates in the horizontal direction).

The upper foamed elastic member 104 and the lower foamed elastic member 105 are made of, for example, urethane, silicon, EPDM (ethylen-propylene-dien terpolymer), or polyolefin. As a foam made of EPDM for example, "EPT sealer®" made by Nitto Denko inc. may be used.

As to the upper foamed elastic member 104 and the lower foamed elastic member 105, it is preferable to have closed-cell foam rather than open-cell foam in which bubbles are interconnected. This is due to the following reasons.

With open-cell foam in which bubbles are basically interconnected, toner easily remains inside the upper foaming elastic members 104 and the lower foaming elastic member 105. If toner remains inside as noted above, expanding and contracting operations of the upper foaming elastic member 104 and the lower foaming elastic member 105 cause the toner to issue from the toner transport path to the outside. Further, if toner remained inside is solidified, the upper foaming elastic member 104 and the lower foaming elastic member 105 can no longer freely expand and contract. On the contrary, with closed-cell foam in which bubbles are not basically interconnected, toner does not remain inside the upper foaming elastic member 104 and the lower foaming elastic member 105, so that such undesirable situations can be prevented.

Further, like the toner transport pipe 101, it is preferable for the upper foamed elastic member 104 to have a minimum internal diameter at its top end and to have a larger internal diameter toward its bottom end. It is also preferable that the internal diameter of the upper foamed elastic member 104 at its bottom end be consistent with the internal diameter of the toner transport pipe 101 at its top end so that no step difference occurs therebetween. Similarly, like the toner transport pipe 101, it is preferable for the lower foamed elastic member 105 to have a minimum internal diameter at its top end and to have a larger internal diameter toward its bottom end. It is also preferable that the internal diameter of the lower foamed elastic member 105 at its bottom end be consistent with an internal diameter of the toner exhaust passage 172 of the transport pipe receiving section 171 at its top end so that no step difference occurs therebetween.

Further, the rotator 106 is disposed in the vicinity of the top end of the protruded tag section 112 of the toner transport pipe 101 so that its axial direction is orthogonal to the up-and-down direction of the toner transport pipe 101. Further, the rotator 106 has transport pipe operation wings 161 and a gear 162. The transport pipe operation wings 161 are disposed on a side where the protruded tag section 112 is provided, with respect to the axis. On the other hand, the gear 162 is disposed on an opposite side to the transport pipe operation wings 161, with respect to the axis.

In the present embodiment, the rotator 106 rotates in response to a rotative driving force of an agitating and transporting member, which agitates and at the same time transports toner inside the toner cartridge 200. To this end, a gear 162 of the rotator 106 goes into engagement with another gear (not shown) that conveys the rotative driving force. The rotator 106 is not limited to this and may be driven by an independent driving source, e.g. a dedicated motor. Since the rotator 106 drives the toner transport pipe 101, regarding its functionality, the rotator belongs to the toner transport device 100. However, structurally, the rotator 106 may be provided in the toner cartridges 200.

In the present embodiment, the rotator 106 is provided with four transport pipe operation wings 161, which are distributed and evenly spaced from each other along a circumferential direction of the rotator 106. Note that, the number of the transport pipe operation wings 161 is not particularly limited. The transport pipe operation wings 161 rotate in response to the rotation of the rotator 106, and act on the toner transport pipe 101 as follows.

First, the transport pipe operation wings 161 hit and contact the operating protrusion section 112*a* of the protruded tag section 112 of the toner transport pipe 101. Next, outer edges of the transport pipe operation wings 161 slide on a top end of the operating protrusion section 112*a*, thereby pushing down the operating protrusion section 112*a* and moving the toner transport pipe 101 downward. Then, the outer edges become detached from the top end of the operating protrusion section 112*a*, so that the toner transport pipe 101 returns in its initial position. Due to a series of such operations, the toner transport pipe 101 vibrates up and down.

As described above, the transport pipe operation wings 161 hit and contact the operating protrusion section 112*a* of the protruded tag section 112 of the toner transport pipe 101. Further, the outer edges of the transport pipe operation wings 161 slide on the top end of the operating protrusion section 112*a* and become detached from the top end section, with the result that the toner transport pipe 101 returns in its initial position. Through the series of such operations, the protruded tag section 112, i.e., the toner transport pipe 101 vibrates from side to side in response to a force acted in the horizontal direction.

In this way, as the transport pipe operation wings 161 of the rotator 106 acts on the operating protrusion section 112*a* of the protruded tag section 112, the toner transport pipe 101 vibrates up and down and from side to side.

With the above structure, in the toner supply device 300, the toner cartridge 200 is mounted on the toner transport device 100 and the developing device 2 is mounted underneath the toner transport device 100. In a state where the three components are mounted, a rotative driving force of the agitating and transporting member, provided inside the toner cartridge 200, is conveyed to the rotator 106 of the toner transport device 100, enabling rotation of the rotator 106.

In the present embodiment, rotation of the rotator 106 is realized utilizing a driving force acting on the agitating and transporting member, thereby moving the toner transport pipe 101. This will be a load for a driving source of the agitating and transporting member, and may slightly affect the rotary motion of the agitating and transporting member. However, the rotary motion of the agitating and transporting member does not adversely affect image quality of the image forming apparatus A including the toner supply device 300.

The motion of the agitating and transporting member inside the toner cartridge 200 causes supply of toner from the toner cartridge 200 to the toner supply port 134 of the toner cartridge mounting section 103 of the toner transport device 100. The toner is passed through the guiding pipe section 131, the toner transport pipe 101, and the toner exhaust passage 172, and supplied to the developing device 2 through the toner exhaust port 173. Since the toner transport device 100 is mounted on the developing device 2, the shutter 174 is in the state where the toner exhaust port 173 is left opened.

In the toner supply device 300, when toner is supplied from the toner cartridge 200 to the developing device 2 via the toner transport device 100, the rotator 106 rotates in response to a driving force acting on the agitating and transporting member. This causes the transport pipe operation wings 161 of the rotator 106 to drive the operating protrusion section 112*a* of the toner transport pipe 101, i.e., the toner transport pipe 101. As a result, the toner transport pipe 101 vibrates up and down and from side to side as described above. This prevents a situation where toner remains inside the toner transport pipe 101 and solidifies resulting in incomplete toner transportation.

In such a manner, the toner transport device 100 prevents retention and solidification of toner inside the toner transport pipe 101 by causing the toner transport pipe 101 to vibrate up and down. The toner transport device 100 does not contain a member, such as a spring agitator or the like, that causes toner residue. This provides high functionality of preventing retention and solidification of toner.

As such, the toner transport device 100 realizes such high functionality of preventing retention and solidification of toner inside the toner transport pipe 101 by causing the toner transport pipe 101 to vibrate up and down. Furthermore, the toner transport device 100 achieves enhanced functionality by allowing the toner transport pipe 101 to vibrate from side to side. In addition, the toner transport pipe 101 serving as a toner transport path has a smooth internal surface with no protrusions and concaves, which also contributes to the enhanced functionality of preventing retention and solidification of toner.

Further, in order for the toner transport pipe 101 to move up and down and to vibrate from side to side, the upper foamed elastic member 104 and the lower foamed elastic member 105 are foamed members including closed-cell foam. The upper foamed elastic member 104 is provided between the toner transport pipe 101 and the toner cartridge mounting section 103, and the lower foamed elastic member 105 is provided between the toner transport pipe 101 and the transport pipe receiving section 171 of the pipe supporting member 102. With the above structure, if the upper foamed elastic member 104 or the lower foamed elastic member 105 expands or contracts, it is possible to prevent (i) a situation where toner issues from the toner transport path to the outside and (ii) a situation where toner remains and solidifies inside the upper foaming elastic member 104 or the lower foaming elastic member 105, which restricts such expanding and contracting operations of the upper foaming elastic member 104 or the lower foaming elastic member 105.

Further, the internal diameter of the toner transport pipe 101 is minimum at its top end, and gradually becomes large toward the downstream so as to be maximum at is bottom end. This facilitates smooth flow of toner supplied from the top end of the toner transport pipe 101, allowing the toner to easily reach the bottom end without causing toner residue somewhere in the toner transport pipe 101.

Further, the positioning protrusion section 133 is provided on the bottom end of the guiding pipe section 131 in the toner cartridge mounting section 103, and the positioning protrusion section 113 is provided on the bottom end of the toner transport pipe 101. The positioning protrusion sections 133 and 113 facilitate positioning of the upper foamed elastic member 104 and the lower foamed elastic member 105. This prevents creation of step differences at a connecting section where the toner transport pipe 101 is connected to the guiding pipe section 131 via the upper foaming elastic member 104 and at a connecting section where toner transport pipe 101 is connected to the transport pipe receiving section 171 via the lower foaming elastic member 105. Such step differences may be causes for toner residue.

Further, since the driving force that rotates the rotator 106 is taken from a driving force that rotates the agitating and transporting member of the toner cartridge 200, the rotator 106 needs no dedicated driving source, enabling to realize such a simple structure.

The exemplary embodiment presented herein is applied to image forming apparatuses, such as e.g. a copier and a printer, in which toner is supplied from a toner replenishing device such as a toner cartridge or the like to a subsequent developing device via a toner transport device.

The toner transport device of the exemplary embodiment presented herein may be arranged such that the supporting member includes: an upper supporting section; a lower supporting section; and an intermediate supporting section disposed therebetween, the upper supporting section and the lower supporting section respectively containing toner passages, and the toner transport path of the toner transport member is connected to the toner passages of the upper supporting section and the lower supporting section via first and second deformable elastic members each containing a toner passage, and the first elastic member being disposed between a top end of the toner transport member and the upper supporting section, and the second elastic member being disposed between a bottom end of the toner transport member and the lower supporting section.

According to the arrangement, the toner transport path of the toner transport member is connected to the toner passages of the supporting members, i.e., the upper supporting section and the lower supporting section, via the deformable elastic members each having a toner passage. With the elastic members, it is possible to properly apply sealing between the toner transport member and the upper supporting section and between the toner transport member and the lower supporting section, without restricting up and down movements of the toner transport member.

In the toner transport device, each of the first and second elastic members may be a foaming elastic member including closed-cell foam in which bubbles are independent from each other.

According to the arrangement, when the upper and the lower elastic members expand and contract in response to up and down movements of the toner transport member, it is possible to prevent (i) a situation where toner issues from the toner transport path of the toner transport member to the outside and (ii) a situation where toner remains and solidifies inside the upper lower elastic member or the lower elastic member and such expanding and contracting operations of the upper and lower elastic members are restricted.

That is, with open-cell foam in which bubbles are basically interconnected, toner easily remains inside the elastic members. If toner remains inside, the expanding and contracting operations of the elastic members in response to the up and down movements of the toner transport member may cause a situation where toner remained inside the elastic members (open-cell foam) issues from the toner transport path to the outside. Further, the toner remained inside the elastic members easily solidifies. On the contrary, with closed-cell foam in which bubbles are not basically interconnected, toner does not remain inside the elastic members, so that such undesirable situations can be avoided.

In the toner transport device, the toner transport path of the toner transport member may have a diameter which gradually becomes larger from a top end toward a bottom end of the toner transport member.

According to the arrangement, the diameter of the toner transport path gradually becomes large from the top end toward the bottom end. This allows smooth flow of toner supplied from the top end of the toner transport path, allowing the toner to easily reach the bottom end without causing toner residue somewhere in the toner transport path.

The toner transport device may be arranged such that the supporting member has in the upper supporting section (i) a first adhesive surface which is adhered to the first elastic member and in the lower supporting section (ii) a second adhesive surface which is adhered to the second elastic member, the toner transport member has on the top end (i) a third adhesive surface which is adhered to the first elastic member and on the bottom end (ii) a fourth adhesive surface which is adhered to the second elastic member, and at least one of the first through fourth adhesive surfaces has a positioning section, provided so as to protrude from the adhesive surface, for positioning the first elastic member and/or the second elastic member in a direction parallel to the adhesive surface.

According to the arrangement, on the adhesive surface of the elastic member where the positioning section is provided, the positioning section enables positioning of the elastic member easily and reliably. This prevents creation of step differences at connecting sections where the toner transport member is connected to the supporting members, i.e., the upper supporting section and the lower supporting section. Such step differences may be causes for toner residue.

The toner transport device may be arranged such that the upper supporting section of the supporting member has thereon a toner replenishing device mounting section where a toner replenishing device is mounted, and the toner replenishing device mounting section includes a deformable elastic member.

According to the arrangement, the toner replenishing device mounting section is provided with a deformable elastic member. This enables insertion of the toner replenishing device onto the toner replenishing device mounting section easily and reliably.

In the toner transport device, the elastic member may be a foaming elastic member including closed-cell foam in which bubbles are independent from each other.

According to the arrangement, the elastic member of the toner replenishing device mounting section is a foaming elastic member including closed-cell foam in which bubbles are independent. This prevents a situation where toner remains and solidifies inside the elastic member of the toner replenishing device mounting section and the expanding and contracting operations of the elastic member are restricted. Further, it is possible to prevent a situation where toner remains inside the elastic member of the toner replenishing device mounting section and then, when the toner replenishing device is inserted onto or removed from the toner replenishing device mounting section, the toner issues from the toner transport path to the outside via the foam of the elastic member.

The toner transport device may be arranged such that the elastic member has thereon a layer causing the layer to have a smaller frictional coefficient than that of a surface of the elastic member.

According to the arrangement, on the surface of the elastic member of the toner replenishing device mounting section, the layer is provided that has a smaller frictional coefficient than that of the surface of the elastic member. This allows smooth operations of inserting and removing the toner replenishing device onto and from the toner replenishing device mounting section by sliding the toner replenishing device on the toner replenishing device mounting section.

The toner transport device may further include a conversion mechanism for converting rotary motion to linear motion, the toner transport member moving up and down in response to a driving force from the conversion mechanism.

According to the arrangement, such a simple structure of the conversion mechanism for converting rotary motion to linear motion allows up-and-down movements of the toner transport member.

The toner transport device may be arranged such that the toner transport member is supported by the supporting member so as to move up and down and vibrate from side to side, and the toner transport member moves up and down and vibrates from side to side, in response to a driving force from the conversion mechanism.

According to the arrangement, the toner transport member vibrates from side to side, as well as moves up and down. This prevents retention and solidification of toner in the tone transport path more reliably than only causing the up-and-down movements of the toner transport member.

The toner transport device may be arranged such that the conversion mechanism includes: an operation receiving section provided in the toner transport member; a rotator acting on the operation receiving section; and a biasing member for biasing the toner transport member to either upward or downward, the rotator has a plurality of operation wings disposed at a plurality of points on the rotator in a circumferential direction of the rotator, and the toner transport member makes an up-and-down movement and a horizontal vibration, repeatedly, the movement and vibration operations being performed by repeatedly (i) causing the operation wings to slide on an edge surface of the operation receiving section in response to rotation of the rotator so as to move the toner transport member up and down against the biasing force applied by the biasing member, and (ii) causing the operation wings to be detached from the edge surface of the operation receiving section.

According to the arrangement, the conversion mechanism having a simple structure includes: the operation receiving section provided in the toner transport member; the rotator having the operation wings disposed in its circumferential direction and act on the operation receiving section; and the biasing member which biases the toner transport member to either upward or downward. Such a simple structure allows an up-and-down movement and a horizontal vibration of the toner transport member.

The toner transport device may be arranged such that the rotator rotates in response to a driving force from a toner replenishing device disposed on the toner transport member, for supplying toner to the toner transport path of the toner transport member.

According to the arrangement, the rotator rotates in response to a driving force acted on toner. The driving force is taken from the agitating and transporting member, which is provided in the toner replenishing device, e.g. the toner cartridge. This allows the rotator to have no dedicated driving source, realizing such a simple structure.

The toner transport device may be arranged such that the supporting member includes: an upper supporting section; a lower supporting section; and an intermediate supporting section disposed therebetween, the upper supporting section and the lower supporting section each containing toner passages, and the lower supporting section has a toner exhaust port, led from the toner passage, in which a shutter is provided for opening and closing.

According to the arrangement, it is possible to appropriately open and close the toner exhaust port, that is led from the toner passage in the lower supporting section of the supporting member. This prevents inadvertent toner leakage through the toner exhaust port of the lower supporting section.

The toner transport device may be arranged such that the shutter is opened by inserting a developing device underneath the lower supporting section, and is closed by removing the developing device from underneath the lower supporting section.

According to the arrangement, in response to insertion or removal of the developing device onto or from the lower supporting section of the supporting member, it is possible to open or close the shutter, i.e., the toner exhaust port led from the toner passage of the supporting member. Specifically, the toner exhaust portion of the lower supporting section automatically corresponds to a state in which the developing device is inserted and needs to be opened or a state in which the developing device is removed and needs to be closed.

The embodiments and concrete examples of implementation discussed in the foregoing detailed explanation serve solely to illustrate the technical details of the technology presented herein, which should not be narrowly interpreted within the limits of such embodiments and concrete examples, but rather may be applied in many variations within the spirit of the exemplary embodiment presented herein, provided such variations do not exceed the scope of the patent claims set forth below.

What is claimed is:

1. A toner transport device comprising:

a toner transport path for passing toner;

a toner transport member disposed so as to have an up-and-down direction in which the toner transport path extends; and a supporting member for supporting the toner transport member, the toner transport member being supported by the supporting member so as to move up and down, wherein the supporting member includes: an upper supporting section; a lower supporting section; and an intermediate supporting section disposed therebetween, the upper supporting section and the lower supporting section respectively containing toner passages, and the toner transport path of the toner transport member is connected to the toner passages of the upper supporting section and the lower supporting section via first and second deformable elastic members each containing a toner passage, and the first elastic member being disposed between a top end of the toner transport member and the upper supporting section, and the second elastic member being disposed between a bottom end of the toner transport member and the lower supporting section.

2. The toner transport device according to claim 1, wherein each of the first and second elastic members is a foaming elastic member including closed-cell foam in which bubbles are independent from each other.

3. The toner transport device according to claim 1, wherein:

the supporting member has in the upper supporting section a first adhesive surface which is adhered to the first elastic member and in the lower supporting section a second adhesive surface which is adhered to the second elastic member, the toner transport member has on the top end a third adhesive surface which is adhered to the first elastic member and on the bottom end a fourth adhesive surface which is adhered to the second elastic member, and at least one of the first through fourth adhesive surfaces has a positioning section, provided so as to protrude from the adhesive surface, for positioning the first elastic member and/or the second elastic member in a direction parallel to the adhesive surface.

4. The toner transport device according to claim 1, wherein the upper supporting section of the supporting member has thereon a toner replenishing device mounting section where a toner replenishing device is mounted, and the toner replenishing device mounting section includes a deformable elastic member.

5. The toner transport device according to claim 4, wherein the elastic member is a foaming elastic member including closed-cell foam in which bubbles are independent from each other.

6. The toner transport device according to claim 4, wherein the elastic member has thereon a layer causing the layer to have a smaller frictional coefficient than that of a surface of the elastic member.

7. The toner transport device according to claim 1, further comprising a conversion mechanism for converting rotary motion to linear motion, the toner transport member moving up and down in response to a driving force from the conversion mechanism.

8. The toner transport device according to claim 7, wherein:

the toner transport member is supported by the supporting member so as to move up and down and vibrate from side to side, and the toner transport member moves up and down and vibrates from side to side, in response to a driving force from the conversion mechanism.

9. The toner transport device according to claim 8, wherein:

the conversion mechanism includes: an operation receiving section provided in the toner transport member; a rotator acting on the operation receiving section; and a biasing member for biasing the toner transport member to either upward or downward, the rotator has a plurality of operation wings disposed at a plurality of points on the rotator in a circumferential direction of the rotator, and the toner transport member makes an up-and-down movement and a horizontal vibration, repeatedly, the movement and vibration operations being performed by repeatedly causing the operation wings to slide on an edge surface of the operation receiving section in response to rotation of the rotator so as to move the toner transport member up and down against the biasing force applied by the biasing member, and causing the operation wings to be detached from the edge surface of the operation receiving section.

10. The toner transport device according to claim 9, wherein the rotator rotates in response to a driving force from a toner replenishing device, disposed on the toner transport member, for supplying toner to the toner transport path of the toner transport member.

11. The toner transport device according to claim 1, wherein:

the supporting member includes: an upper supporting section; a lower supporting section; and an intermediate supporting section disposed therebetween, the upper supporting section and the lower supporting section each containing toner passages, and the lower supporting section has a toner exhaust port, led from the toner passage, in which a shutter is provided for opening and closing.

12. The toner transport device according to claim 11, wherein the shutter is opened by inserting a developing device underneath the lower supporting section, and is closed by removing the developing device from underneath the lower supporting section.

13. A toner transport device comprising:

a toner transport path for passing toner;

a toner transport member disposed so as to have an up-and-down direction in which the toner transport path extends; and a supporting member for supporting the toner transport member, the toner transport member being supported by the supporting member so as to move up and down wherein the toner transport path of the toner transport member has a diameter which gradually becomes larger from a top end toward a bottom end of the toner transport member.

14. A toner supply device comprising:

a toner transport device;

a toner replenishing device; and a developing device, the toner transport device including: a toner transport path for passing toner; a toner transport member disposed so as to have an up-and-down direction in which the toner transport path extends; and a supporting member for supporting the toner transport member, the toner transport member being supported by the supporting member so as to move up and down, the toner replenishing device being inserted onto the toner transport device, the developing device being inserted underneath the toner transport device and receiving toner replenished by the toner replenishing device via the toner transport device wherein the supporting member includes: an upper supporting section; a lower supporting section; and an intermediate supporting section disposed therebetween, the upper supporting section and the lower supporting section respectively containing toner passages, and the toner transport path of the toner transport member is connected to the toner passages of the upper supporting section and the lower supporting section via first and second deformable elastic members each containing a toner passage, and the first elastic member being disposed between a top end of the toner transport member and the upper supporting section, and the second elastic member being disposed between a bottom end of the toner transport member and the lower supporting section.

15. An image forming apparatus comprising a toner supply device including:

a toner transport device;

a toner replenishing device; and a developing device, the toner transport device including: a toner transport path for passing toner; a toner transport member disposed so as to have an up-and-down direction in which the toner transport path extends; and a supporting member for supporting the toner transport member, the toner transport member being supported by the supporting member so as to move up and down, the toner replenishing device being inserted onto the toner transport device, the developing device being inserted underneath the toner transport device and receiving toner replenished by the toner replenishing device via the toner transport device, wherein the supporting member includes: an upper supporting section; a lower supporting section; and an intermediate supporting section disposed therebetween, the upper supporting section and the lower supporting section respectively containing toner passages, and the toner transport path of the toner transport member is connected to the toner passages of the upper supporting section and the lower supporting section via first and second deformable elastic members each containing a toner passage, and the first elastic member being disposed between a top end of the toner transport member and the upper supporting section, and the second elastic member being disposed between a bottom end of the toner transport member and the lower supporting section.

* * * * *